United States Patent [19]

Gropp

[11] 4,130,094

[45] Dec. 19, 1978

[54] EXHAUST GAS RECIRCULATION VALVE ASSEMBLY

[75] Inventor: Karl H. Gropp, Grosse Pointe Woods, Mich.

[73] Assignee: Ford Motor Company, Dearborn, Mich.

[21] Appl. No.: 821,442

[22] Filed: Aug. 3, 1977

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,814,070 | 6/1974 | Wertheimer | 123/119 A |
| 3,834,363 | 9/1974 | Goto | 123/119 A |
| 3,885,538 | 5/1975 | Suter | 123/119 A |
| 3,974,807 | 8/1976 | Nohira | 123/119 A |
| 3,981,283 | 9/1976 | Kaufman | 123/119 A |
| 4,071,006 | 1/1978 | Harada | 123/119 A |

FOREIGN PATENT DOCUMENTS

| | | | |
|---|---|---|---|
| 2417001 | 12/1974 | Fed. Rep. of Germany | 123/119 A |

*Primary Examiner*—Wendell E. Burns

*Attorney, Agent, or Firm*—Robert E. McCollum; Keith L. Zerschling

[57] ABSTRACT

An engine exhaust gas recirculating (EGR) valve assembly that maintains the EGR valve in the position to which it is actuated by means of a rolling diaphragm air bleed device that alternately covers and uncovers an atmospheric vent opening until an equilibrium position is maintained.

9 Claims, 5 Drawing Figures

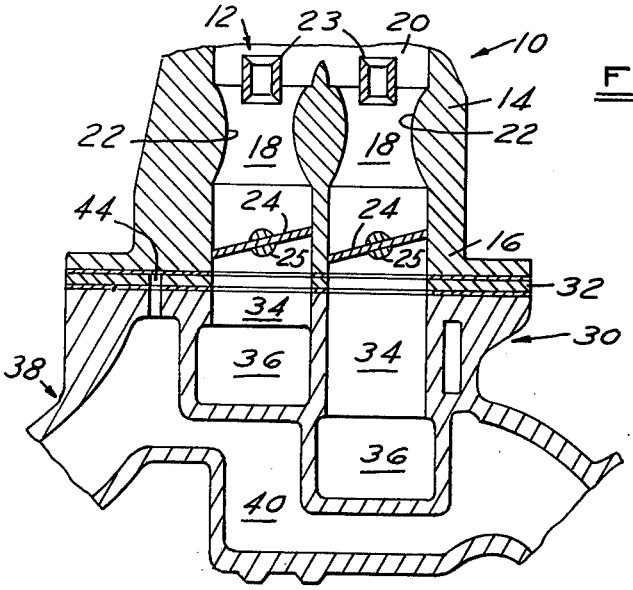
FIG. 1
FIG. 3
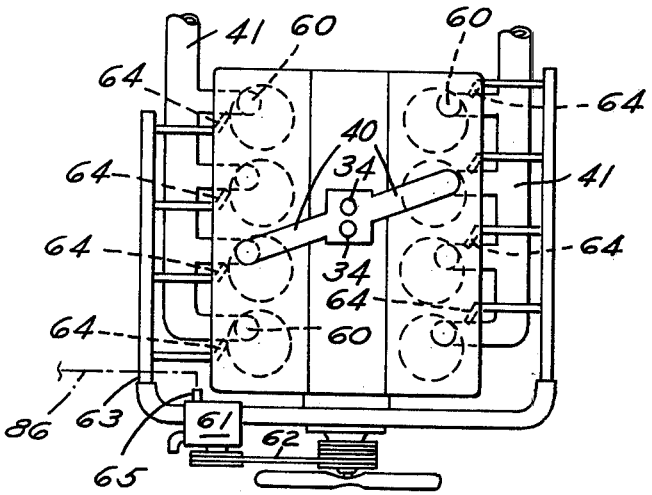
FIG. 2
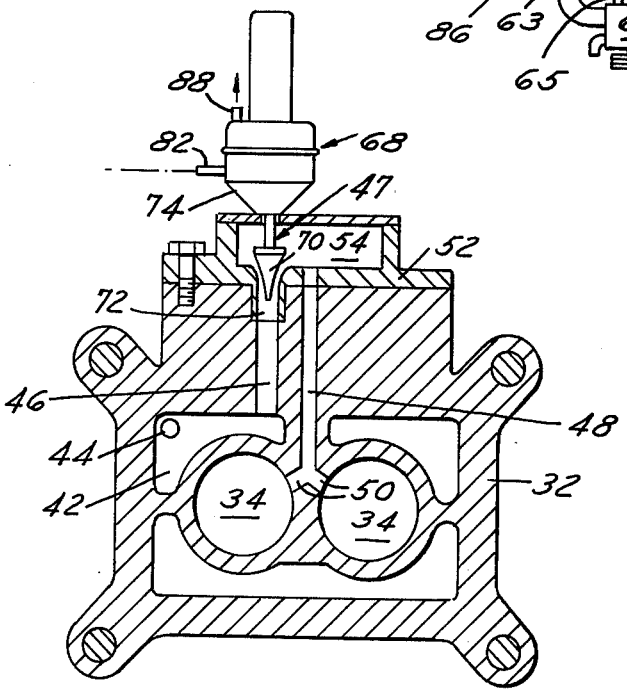

EXHAUST GAS RECIRCULATION VALVE ASSEMBLY

This invention relates in general to an automotive type engine exhaust gas recirculation (EGR) system. More particularly, it relates to the specific design of an EGR valve assembly that will maintain the valve in a fixed position regardless of the unbalance of forces that act on the valve head.

EGR valve assemblies are commonly used to reduce $NO_x$ levels in automotive type engines by recirculating a certain proportion of the engine exhaust gases into the engine to dilute the intake charge and reduce the combustion chamber peak pressure and temperature levels. For example, U.S. Pat. No. 3,762,384 shows a construction in which engine vacuum operates a servo to open an EGR valve to connect the engine exhaust gases to the engine intake manifold. The opening of the valve subjects the valve head to a differential of forces between the manifold vacuum and the exhaust gas pressure. Thus, as the valve opens, the valve may not maintain the position selected but drift because of the unbalance of forces acting on the valve head. This same condition occurs in known similarly constructed devices such as is shown in U.S. Pat. No. 3,799,131, Bolton; U.S. Pat. No. 3,834,366, Kingsbury and U.S. Pat. No. 3,756,210, Kuehl. All of the latter show engine exhaust gas backpressure controlled EGR valve assemblies that maintain a constant pressure zone downstream of the EGR valve by the mechanisms shown. They also regulate the position of the EGR valve by air bleed devices that cause the valve to seek an equilibrium position for each actuating force moving the valve to an open position. U.S. Pat. No. 3,796,049, Hayashi, also shows an EGR valve having an unbalance of forces acting on the EGR valve once it has opened.

It is a primary object of this invention to provide an EGR valve assembly that will maintain a fixed position of the valve regardless of the unbalance of forces acting on the valve once it is open.

It is another object of the invention to provide an EGR valve assembly as described above that is simple in construction and operation and maintains the fixed position by the use of a rolling seal member providing a unique construction.

It is a further object of the invention to provide an EGR valve assembly with a rolling seal air bleed device that will maintain the EGR valve in a fixed position once it has been moved there by an actuator.

Other objects, features and advantages of the invention will become more apparent upon reference to the succeeding detailed description thereof and to the drawings illustrating the preferred embodiment thereof, wherein FIG. 1 is a cross-sectionl view of an internal combustion engine and associated carburetor embodying the invention;

FIG. 2 is a cross-sectional view taken on a plane indicated by and viewed in the direction of the arrows 2—2 of FIG. 1;

FIG. 3 illustrates schematically the engine on which is mounted the invention;

Figure 5:
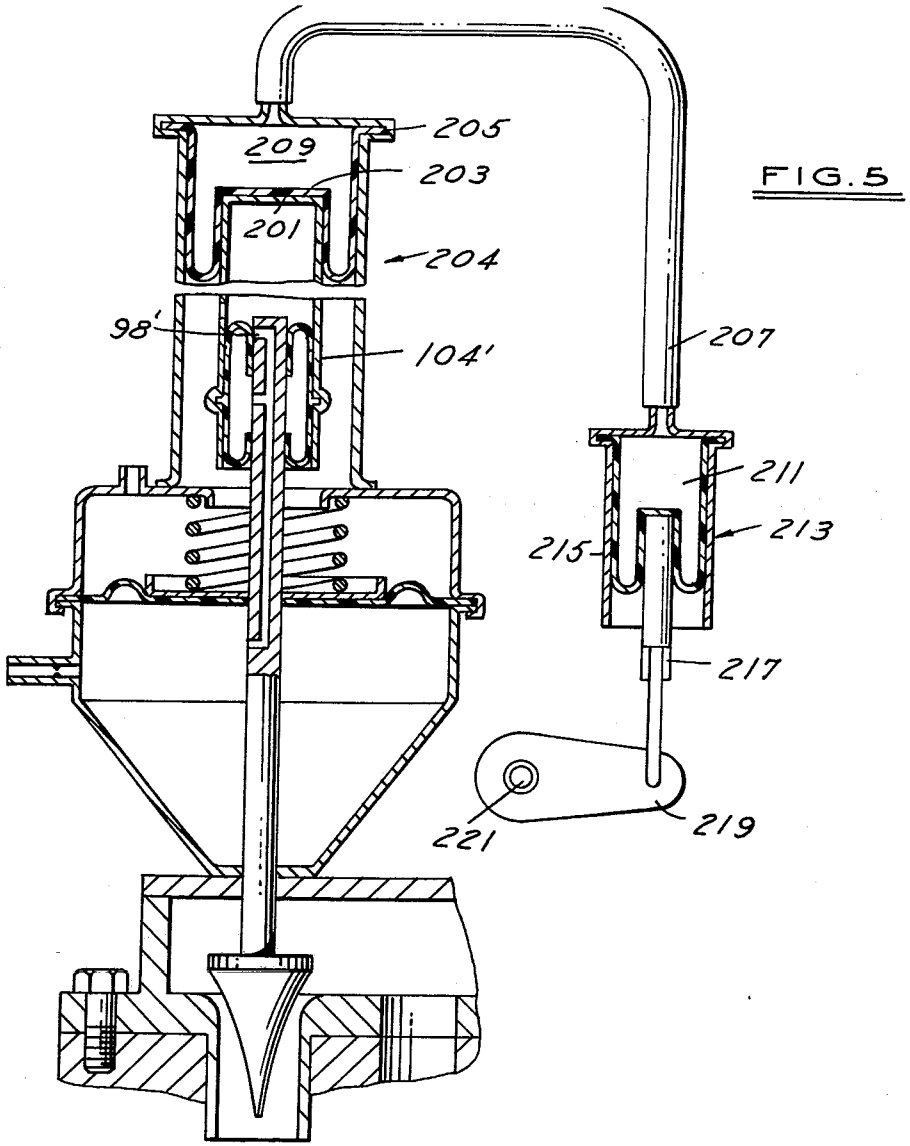

FIG. 1 illustrates a portion 10 of a two-barrel carburetor of a known downdraft type. It has an air horn section 12, a main body portion 14, and a throttle body 16, joined by suitable means not shown. The carburetor has the usual air/fuel induction passages 18 open at their upper ends 20 to fresh air from the conventional air cleaner, not shown. Passages 18 have the usual fixed area venturies 22 cooperating with booster venturies 23 through which the main supply of fuel is inducted, by means not shown.

Flow of air and fuel through induction passages 18 is controlled by a pair of throttle valve plates 24 each fixed on a shaft 25 rotatably mounted in the side walls of the carburetor body.

The throttle body 16 is flanged as indicated for bolting to the top of the engine intake manifold 30, with a spacer element 32 located between. Manifold 30 has a number of vertical risers or bores 34 that are aligned for cooperation with the discharge end of the carburetor induction passages 18. The risers 34 extend at right angles at their lower ends 36 for passage of the mixture out of the plane of the figure to the intake valves of the engine.

The exhaust manifolding part of the engine cylinder head is indicated partially at 38, and includes an exhaust gas crossover passage 40, shown also in FIG. 3. The latter passes from the exhaust manifold 41, shown in FIG. 3, on one side of the engine to the opposite side beneath the manifold trunks 36 to provide the usual "hot spot" beneath the carburetor to better vaporize the air/fuel mixture.

As best seen in FIG. 2, the spacer 32 is provided with a worm-like recess 42 that is connected directly to crossover passage 40 by a bore 44. Also connected to recess 42 is a passage 46 alternately blocked by an exhaust gas recirculating (EGR) valve 47 or connected to a central bore or passage 48 communicating with the risers 34 through a pair of ports 50. A housing 52 attached to the side of the spacer defines a chamber 54 through which passages 46 and 48 are interconnected.

FIG. 3 shows schematically a plan view of a portion of a conventional V-8 internal combustion engine 10 having right and left banks of cylinders each with exhaust ports 60. Also shown is an air injection system consisting of an air pump 61 driven by the engine through a belt 62 to deliver air to each exhaust port through manifolding 63 and injectors 64. The air combines with the unburned hydrocarbons and carbon monoxide that pass into the exhaust system and reduces them to $H_2O$ and $CO_2$. The air pump has a third outlet 65.

Figure 4:
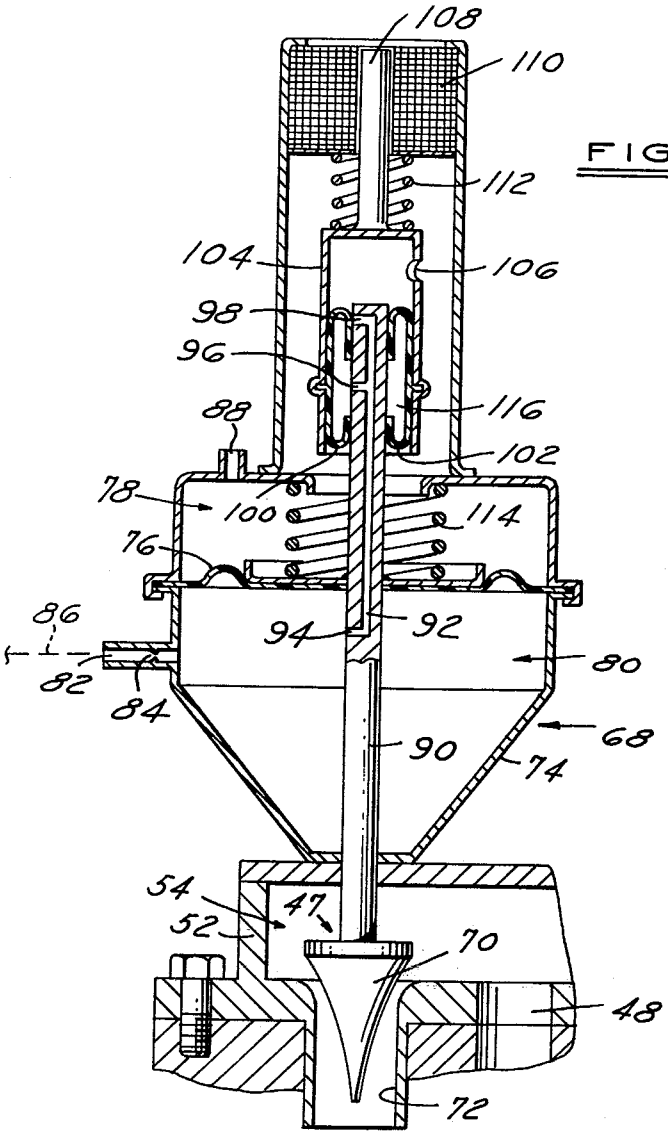
FIG. 4 is a cross-sectional view on an enlarged scale of an EGR valve assembly embodying the invention; and, FIG. 5 is a cross-sectional view similar to that shown in FIG. 4 and illustrating a modified version of the invention.

As seen in FIG. 4, the EGR valve 47 is adapted to be actuated by a servo 68. The EGR valve in this case consists of a cone shaped pintle 70 cooperating with a fixed nozzle 72. The two are constructed and designed as to provide sonic velocity to the flow through the area between the two over essentially the entire manifold vacuum operating range of the engine. Such a construction is more clearly shown and described in U.S. Pat. No. 3,981,283, Kaufman, assigned to the assignee of this invention.

The servo 68 includes a shell 74 divided by an edge mounted flexible annular diaphragm 76 into an atmospheric air chamber 78 and a variable or superatmospheric pressure chamber 80. Chamber 80 is connected by tube 82 past a restriction or orifice 84 to the output 65 of air pump 61 by a line 86. The air chamber 78 is vented to atmosphere or ambient through an opening 88.

The EGR valve 47 is connected by a stem 90 to diaphragm 76 and extends through the diaphragm in a sealing manner as shown. The stem contains a bypass passage 92 that has one outlet or port 94 that opens into the superatmospheric pressure chamber 80. At its opposite end, passage 92 has a pair of outlets 96 and 98. Overlying outlet 96 is an annular flexible rolling seal member 100 that is secured at its inner diameter to the valve stem 90. The seal member normally uncovers the outlet 98 but at times rolls over the outlet to seal the same. That is, the outer portion of the annular flexible seal 100 is secured in holes to an open end cylindrical actuator 104 having an air vent hole 106. An actuating stem 108 is secured to the upper end of the cylinder and consists of the armature of a solenoid 110. The solenoid is connected electrically to the vehicle electrical system, by means not shown. A light spring 112 biases the actuator or regulator in a direction uncovering outlet 98. A heavier preloaded spring 114 normally biases the large diaphragm 76 in an EGR valve closing direction.

In operation, with the engine off, air at ambient or atmospheric pressure will exist in both chambers 80 and 78 permitting spring 114 to move the diaphragm 76 and valve stem 90 downwardly as shown in FIG. 4 to seat the EGR valve in a closed position. Once the engine is started, so long as the solenoid 110 of the position regulator 108 remains deenergized, the spring 112 will position the diaphragm 102 to uncover outlet 98. This will permit atmospheric pressure entering chamber 78 through hole 88 and hole 106 in the cylindrical member 104 to communicate with chamber 80 through the passage 92. It should be noted that the restriction 84 is chosen to be smaller in area than the area of outlet 98. Accordingly, the bleed of atmospheric air into the chamber 80 will decay the pressure in chamber 80 to a level below the force of spring 114 and thus keep the EGR valve closed.

As soon as a signal energizes the solenoid 110, the actuator 104 will move upwardly rolling the seal member 100 in the same direction to cover outlet 98 and block off the communication of air in atmospheric pressure through passage 92 to chamber 80. The pressure then begins to build up in chamber 80 and in the chamber 116 defined within the flexible seal member 100. This causes the portion of the rolling seal covering outlet 98 to seal the outlet with more force. The pressure build up in chamber 80 then moves the diaphragm 76 upwardly to open the EGR valve to the position called for by the distance traveled by the actuator 104. This, of course, will be scheduled in accordance with engine operating conditions by any convenient means. As the diaphragm 76 and stem 90 continue to move upwardly, a point will be reached where outlet 98 again becomes uncovered and begins communicating atmospheric air to chamber 80. The decay or bleeddown of pressure in chamber 80 then permits the spring 114 to retun the diaphragm 76 downwardly in an attempt to close the EGR valve. This again causes the outlet 98 to become covered. The stem, therefore, hunts back and forth until an equilibrium position is established for each movement of the regulator 104. The EGR valve 47, therefore, is maintained in the position called for by the regulator.

FIG. 5 shows a modified version of the invention in which pneumatic pistons interconnected with the carburetor throttle valve are used as the regulating mechanism instead of solenoid 110 to control the positioning of the EGR valve. More specifically, the upper end 201 of cylindrical portion 104' of the regulator in this case is attached to one portion 203 of an annular flexible rolling member 204. The opposite end 205 is edge mounted in a portion of the servo shell. A passage 207 interconnects the interior or chamber 209 defined within the flexible member 204 to the interior of a second chamber 211 defined by a second annular flexible member 213. The latter is similarly mounted in a cylindrical member 215 open at one end and is fixed to the end of a plunger 217. The plunger is pivotally connected by a link 219 to the carburetor throttle valve shaft 221.

Initially, the two chambers 209 and 211 and tube 207 would be filled with a relatively non-compressible liquid. Thereafter, clockwise movement of the throttle valve 16 from the idle speed position shown in FIG. 1 would expand the chamber 211 to provide a corresponding contraction of chamber 209. This will cause an upward movement of the cylindrical regulator sleeve 104 to cover the outlet port 98' similar to the manner previously described and cause an opening of the EGR valve in proportion to the degree of throttle lever opening movement. Closing down of the throttle valve towards the idle speed position will permit the throttle valve closing spring (not shown) to pull the throttle valve down and cause a corresponding closing of the EGR valve.

From the foregoing, it will be seen that the invention provides an EGR valve positioner that will maintain the EGR valve in a fixed position regardless of the force unbalance acting on the valve when in an open position. It will also be seen that the use of rolling diaphragms offers little resistance to movement and therefore requires minimal force for the actuator to move the regulator. It will also be seen that there is no relative motion between the rolling diaphragm and the valve stem so that durability is maximized when compared to poppet type regulators. The rolling diaphragm also permits axial as well as angular misalignment relative to the valve stem and the cylindrical portion of the regulator. Also, the gradual closing of the outlet port 98 by the rolling action of the diaphragm minimizes sudden pressure changes and therefore minimizes the hunting commonly present in other constructions of the air bleed valve type.

While the invention has been shown and described in its preferred embodiments, it will be clear to those skilled in the arts to which it pertains that many changes and modifications may be made thereto without departing from the scope of the invention.

I claim:

1. An engine exhaust gas recirculating (EGR) valve assembly, comprising in combination, a duct connecting engine exhaust gases to the engine intake manifold, an (EGR) valve movable into and out of the duct to block or permit flow of gases through the duct, a spring biasing the (EGR) valve into the duct to a closed position, fluid pressure actuated force means connected to the (EGR) valve for moving it to an open position against the forces of gases and manifold pressure acting in the duct on the valve, means connecting a source of varying pressure to the force means to actuate the same, a movable atmospheric bleed device movable to decay the pressure from the source below a level operative to effect opening of the (EGR) valve, and control means operably connected to the bleed device to move the same to control the decay of source pressure force, the force means including a servo having a diaphragm dividing the servo into an atmospheric pressure chamber on one side and a variable fluid pressure chamber on the other side, a valve stem connected to the (EGR) valve and to the diaphragm and projecting through the diaphragm from one side to the other, the bleed device including bypass passage means in the stem having an outlet opening into each chamber for decaying the pressure in one chamber to the level of the pressure in the other chamber, and rollable flexible seal means movable by the control means between a first position uncovering the outlet in one chamber to expose the latter outlet to atmospheric pressure to equalize the level of the pressures in the chambers to thereby permit movement of the diaphragm in a valve closing direction by the spring or movable to a second position to cover the latter outlet to permit a change in the force level of the pressure in the variable pressure chamber to effect an (EGR) valve opening movement of the diaphragm, the latter movement of the diaphragm moving the stem relative to the seal means to again uncover the latter outlet and again effect the movement of the diaphragm and stem and (EGR) valve in a valve closing direction, the valve moving back and forth until an equilibrium position is attained for each movement of the control means.

2. An (EGR) valve assembly as in claim 1, including an additional outlet to the bypass passage located in the atmospheric chamber adjacent the first named outlet, the flexible seal means forming a fluid pressure chamber located over the additional outlet to be pressurized by the variable pressure, the first named outlet being sealed by the pressurized rolling seal means as it is moved by the control means to cover the outlet.

3. An engine exhaust gas recirculating (EGR) valve assembly, comprising in combination, a duct connecting engine exhaust gases to the engine intake manifold, an (EGR) valve movable into and out of the duct to block or permit flow of gases through the duct, a spring biasing the (EGR) valve into the duct to a closed position, fluid pressure actuated force means connected to the (EGR) valve for moving it to an open position against the forces of gases and manifold pressure acting in the duct on the valve, conduit means connecting a source of varying pressure to the force means to actuate the same, a movable atmospheric bleed device movable to decay the pressure from the source below a level operative to effect opening of the (EGR) valve, and control means operably connected to the bleed device to move the same to control the decay of source pressure force, the force means including a servo having a diaphragm dividing the servo into an atmospheric pressure chamber on one side and a variable fluid pressure chamber on the other side, passage means extending through the diaphragm providing communication of pressures on opposite sides of the diaphragm, the bleed device including rollable flexible seal means rollable by the control means between a first position uncovering the passage means in one chamber to expose the passage means to atmospheric pressure to equalize the level of the pressures in the chambers to thereby permit movement of the diaphragm in an (EGR) valve closing direction by the spring or to a second position to cover and seal the passage means in the one chamber to permit a change in the force level of the pressure in the variable pressure chamber to effect an (EGR) valve opening movement of the diaphragm, the latter movement of the diaphragm moving the stem relative to the slide valve means to again uncover the passage means and again effect the movement of the diaphragm and stem and (EGR) valve in a valve closing direction, the valve moving back and forth until an equilibrium position is attained for each movement of the control means, the conduit means having a flow area less than the flow area of the passage means.

4. An (EGR) valve assembly as in claim 3, the passage means including an outlet in the atmospheric pressure chamber surrounded by the seal means to form a flexible pressure chamber that rolls over the passage means in response to the control means to seal the passage means at that point from communiction with the atmospheric pressure chamber.

5. An (EGR) valve assembly as in claim 3, including electrical means connected to the control means for operating the same in response to an electrical input signal from the engine.

6. An (EGR) valve assembly as in claim 3, including second fluid pressure operating means connected to the control means and operable in response to movement of a carburetor throttle valve to move the rollable seal means.

7. An (EGR) valve assembly as in claim 6, the second fluid pressure operated means comprising a pair of interconnected pneumatically operated pistons for transmitting the force and movement of one to the other, and linkage means between the throttle valve and one of the pneumatic pistons for directly actuating the same upon movement of the throttle valve.

8. An (EGR) valve assembly as in claim 3, the passage means being formed in a valve stem secured to the (EGR) valve and diaphragm and projecting through the diaphragm with an outlet to the passage means on each side of the diaphragm, the rollable seal means comprising a rollable flexible diaphragm having one portion secured to the control means and an opposite portion secured to the valve stem straddling an outlet to seal the same, an additional outlet from the passage means, the additional outlet being in the chamber defined by the seal means adapted to be covered and uncovered by the rolling movement of the seal means to alternatively expose the additional outlet and passage means to the chamber pressure or cover the additonal outlet to permit the buildup of pressure in the other chamber, the other chamber pressure pressurizing the seal means upon covering of the additional outlet to seal the additional outlet.

9. An (EGR) valve assembly as in claim 8 the control means including an open end cylindrical-like member receiving the seal means therein and to which the seal means is secured.

* * * * *